US011339532B2

(12) United States Patent
Miller et al.

(10) Patent No.: US 11,339,532 B2
(45) Date of Patent: May 24, 2022

(54) MODIFIED FIBER FROM SHREDDED PULP SHEETS, METHODS, AND SYSTEMS

(71) Applicant: International Paper Company, Memphis, TN (US)

(72) Inventors: Charles E. Miller, Federal Way, WA (US); Alan D. Lovas, Auburn, WA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 16/192,526

(22) Filed: Nov. 15, 2018

(65) Prior Publication Data

US 2019/0085508 A1 Mar. 21, 2019

Related U.S. Application Data

(62) Division of application No. 14/983,402, filed on Dec. 29, 2015, now Pat. No. 10,156,042.

(51) Int. Cl.
*D21C 9/00* (2006.01)
*D21H 13/06* (2006.01)
(Continued)

(52) U.S. Cl.
CPC ..... *D21C 9/002* (2013.01); *D21B 1/066* (2013.01); *D21C 9/001* (2013.01); *D21C 9/005* (2013.01);
(Continued)

(58) Field of Classification Search
CPC ..... D21C 9/005; D21C 9/002; D21C 9/00; D21C 9/001; D21C 9/007; D21H 11/20;
(Continued)

(56) References Cited

U.S. PATENT DOCUMENTS 3,224,926 A 12/1965 Bernardin
3,241,553 A 3/1966 Steiger
(Continued)

FOREIGN PATENT DOCUMENTS

CN 1191002 A 8/1998
CN 1284144 A 2/2001
(Continued)

OTHER PUBLICATIONS

International Search Report and Written Opinion dated Mar. 22, 2017, issued in corresponding International Application No. PCT/US2016/068417, filed Dec. 22, 2016, 15 pages.
(Continued)

*Primary Examiner* — Jose A Fortuna
(74) *Attorney, Agent, or Firm* — Thomas W. Barnes, III; Clifford R. Lamar, II

(57) ABSTRACT

Methods of forming crosslinked cellulose include mixing a crosslinking agent with cellulose mat fiber fragments composed of hydrogen-bonded cellulose fibers and having a solids content of about 45-95% to form a substantially homogenous mixture of non-crosslinked, individualized cellulose fibers, drying the resulting mixture to 85-100% solids, then curing the dried mixture under conditions effective to crosslink the cellulose fibers. Some of such methods may include fragmenting a cellulose fiber mat to form the mat fragments. Systems include a mixing unit (such as a high-consistency mixer) configured to form, from the mat fragments and a crosslinking agent, a substantially homogenous mixture of non-crosslinked, individualized cellulose fibers and crosslinking agent, at ambient conditions, a drying unit to dry the substantially homogenous mixture to a consistency of 85-100%, and a curing unit and to cure the crosslinking agent to form dried and cured crosslinked cellulose fibers.

14 Claims, 1 Drawing Sheet

(51) Int. Cl.

| | |
|---|---|
| ***D21B 1/06*** | (2006.01) |
| ***D21H 17/37*** | (2006.01) |
| ***D21H 17/38*** | (2006.01) |
| ***D21H 17/39*** | (2006.01) |
| ***D21H 15/02*** | (2006.01) |

(52) U.S. Cl.
CPC ..... *D21C 9/007* (2013.01); *D21H 13/06* (2013.01); *D21H 15/02* (2013.01); *D21H 17/37* (2013.01); *D21H 17/38* (2013.01); *D21H 17/39* (2013.01)

(58) Field of Classification Search
CPC ..... D21H 17/37; D21H 11/16; D21H 13/06; D21H 15/02; D21H 17/38; D21H 17/39; D21B 1/066
See application file for complete search history.

(56) References Cited

U.S. PATENT DOCUMENTS

| | | | | |
|---|---|---|---|---|
| 3,440,135 | A | 4/1969 | Chung | |
| 3,526,048 | A | 9/1970 | Rowland et al. | |
| 3,658,613 | A | 4/1972 | Steiger | |
| 3,756,913 | A | 9/1973 | Wodka | |
| 3,819,470 | A | 6/1974 | Shaw et al. | |
| 3,932,209 | A | 1/1976 | Chatterjee | |
| 4,035,147 | A | 7/1977 | Sangenis et al. | |
| 4,285,690 | A | 8/1981 | North | |
| 4,332,586 | A | 6/1982 | North | |
| 4,391,878 | A | 7/1983 | Drach | |
| 4,396,391 | A | 8/1983 | North | |
| 4,420,368 | A | 12/1983 | Drach | |
| 4,431,481 | A | 2/1984 | Drach et al. | |
| 4,455,416 | A | 6/1984 | Floyd et al. | |
| 4,505,712 | A | 3/1985 | Floyd et al. | |
| 4,689,118 | A | 8/1987 | Makoui et al. | |
| 4,820,307 | A | 4/1989 | Welch et al. | |
| 4,822,453 | A | 4/1989 | Dean et al. | |
| 4,853,086 | A | 8/1989 | Graef | |
| 4,888,093 | A | 12/1989 | Dean et al. | |
| 4,889,595 | A | 12/1989 | Herron et al. | |
| 4,889,596 | A | 12/1989 | Schoggen et al. | |
| 4,889,597 | A | 12/1989 | Bourbon et al. | |
| 4,898,642 | A | 2/1990 | Moore et al. | |
| 4,900,324 | A | 2/1990 | Chance et al. | |
| 4,935,022 | A | 6/1990 | Lash et al. | |
| 4,936,865 | A | 6/1990 | Welch et al. | |
| 4,975,209 | A | 12/1990 | Welch et al. | |
| 5,049,235 | A | 9/1991 | Barcus et al. | |
| 5,137,537 | A | 8/1992 | Herron et al. | |
| 5,160,789 | A | 11/1992 | Barcus et al. | |
| 5,183,707 | A * | 2/1993 | Herron | D06M 13/192 162/157.6 |
| 5,190,563 | A | 3/1993 | Herron et al. | |
| 5,221,285 | A | 6/1993 | Andrews et al. | |
| 5,225,047 | A | 7/1993 | Graef et al. | |
| 5,279,709 | A * | 1/1994 | Niskanen | B01F 3/1221 162/52 |
| 5,366,591 | A | 11/1994 | Jewell | |
| 5,442,899 | A | 8/1995 | Shibazaki et al. | |
| 5,447,977 | A | 9/1995 | Hansen et al. | |
| 5,496,476 | A | 3/1996 | Tang et al. | |
| 5,496,477 | A | 3/1996 | Tang et al. | |
| 5,536,369 | A | 7/1996 | Norlander | |
| 5,549,791 | A | 8/1996 | Herron et al. | |
| 5,556,976 | A | 9/1996 | Jewell | |
| 5,562,740 | A | 10/1996 | Cook et al. | |
| 5,698,074 | A | 12/1997 | Barcus et al. | |
| 5,705,475 | A | 1/1998 | Tang et al. | |
| 5,728,771 | A | 3/1998 | Tang et al. | |
| 5,843,061 | A | 12/1998 | Chauvette et al. | |
| 5,873,979 | A | 2/1999 | Naieni | |
| 5,981,739 | A | 11/1999 | Anderson et al. | |
| 5,998,511 | A | 12/1999 | Westland et al. | |
| 6,300,259 | B1 | 10/2001 | Westland et al. | |
| 6,306,251 | B1 | 10/2001 | Jewell et al. | |
| 6,436,231 | B1 | 8/2002 | Graef et al. | |
| 6,562,192 | B1 * | 5/2003 | Hamilton | A61F 13/15634 162/141 |
| 6,620,865 | B2 | 9/2003 | Westland et al. | |
| 6,899,790 | B2 * | 5/2005 | Lee | D21C 9/007 162/111 |
| 7,018,508 | B2 * | 3/2006 | Yancey | C04B 18/241 162/100 |
| 7,291,244 | B2 * | 11/2007 | DeZutter | D21B 1/068 162/261 |
| 7,396,435 | B2 * | 7/2008 | DeZutter | D21B 1/061 162/28 |
| 7,608,167 | B2 | 10/2009 | Luo et al. | |
| 8,277,606 | B2 * | 10/2012 | Lee | D21C 9/007 162/9 |
| 8,906,198 | B2 * | 12/2014 | Sabourin | D21H 11/18 162/9 |
| 9,458,297 | B2 | 10/2016 | Miller | |
| 9,803,320 | B2 | 10/2017 | Dorris | |
| 10,156,042 | B2 * | 12/2018 | Miller | D21C 9/005 |
| 2001/0020520 | A1 * | 9/2001 | Hu | D21C 9/004 162/9 |
| 2001/0040015 | A1 * | 11/2001 | Lee | D21C 9/007 162/9 |
| 2003/0141028 | A1 * | 7/2003 | Vrbanac | C04B 18/241 162/157.6 |
| 2003/0188449 | A1 * | 10/2003 | Yancey | C04B 18/241 34/221 |
| 2004/0054331 | A1 * | 3/2004 | Hamilton | A61F 13/53704 604/200 |
| 2004/0224588 | A1 | 11/2004 | Cook et al. | |
| 2005/0022415 | A1 | 2/2005 | Yancey et al. | |
| 2005/0045290 | A1 | 3/2005 | Hamed et al. | |
| 2005/0145348 | A1 * | 7/2005 | Lee | D21C 9/007 162/4 |
| 2005/0247419 | A1 | 11/2005 | Hamed et al. | |
| 2006/0118255 | A1 | 6/2006 | Sears et al. | |
| 2009/0199349 | A1 * | 8/2009 | Weinstein | D06M 13/203 8/120 |
| 2011/0077354 | A1 | 3/2011 | Stoyanov et al. | |
| 2012/0004406 | A1 | 1/2012 | Stoyanov et al. | |
| 2013/0126111 | A1 * | 5/2013 | Hage | D21C 9/10 162/76 |
| 2013/0137862 | A1 | 5/2013 | Stoyanov et al. | |
| 2015/0376347 | A1 * | 12/2015 | Miller | C08J 3/24 525/54.23 |
| 2016/0369454 | A1 | 12/2016 | Miller | |
| 2017/0022314 | A1 | 1/2017 | Brogan et al. | |
| 2017/0022671 | A1 | 1/2017 | Brogan et al. | |
| 2017/0066865 | A1 | 3/2017 | Brogan et al. | |
| 2017/0183817 | A1 * | 6/2017 | Miller | D21C 9/002 |
| 2019/0085508 | A1 * | 3/2019 | Miller | D21C 9/002 |
| 2020/0040525 | A1 * | 2/2020 | Luo | C08L 1/28 |

FOREIGN PATENT DOCUMENTS

| | | | | |
|---|---|---|---|---|
| CN | 1346415 | A | 4/2002 | |
| JP | H11508327 | A | 7/1999 | |
| WO | WO-9700354 | A1 * | 1/1997 | D21C 9/005 |
| WO | WO-2005035871 | A2 * | 4/2005 | D21C 9/002 |
| WO | WO-2016003727 | A1 * | 1/2016 | C08J 3/24 |
| WO | WO-2017117023 | A1 * | 7/2017 | D21C 9/002 |

OTHER PUBLICATIONS

International Preliminary Examination Report and Written Opinion dated Jul. 12, 2018, issued in corresponding International Application No. PCT/US2016/068417, filed Feb. 22, 2016, 10 pages.
Official Action dated Apr. 11, 2019, issued in corresponding Chilean Application No. 2018-001746, filed Dec. 22, 2016, with machine translation, 16 pages.
Office Action dated May 25, 2020, issued in Russian Patent Application No. 2018127672, filed Dec. 22, 2016, 12 pages.
Search Report completed May 14, 2020, issued in Russian Patent

(56) References Cited

OTHER PUBLICATIONS

Application No. 2018127672, filed Dec. 22, 2016, 4 pages.
Official Action (Search Report) dated Jan. 28, 2020, in corresponding Brazilian Application No. BR112018013401-5, filed Dec. 22, 2016, with machine translation, 8 pages.
Office Action dated Jun. 22, 2020, in corresponding Chinese Application No. 201680077129.X, filed Dec. 22, 2016, with translation, 20 pages.

* cited by examiner

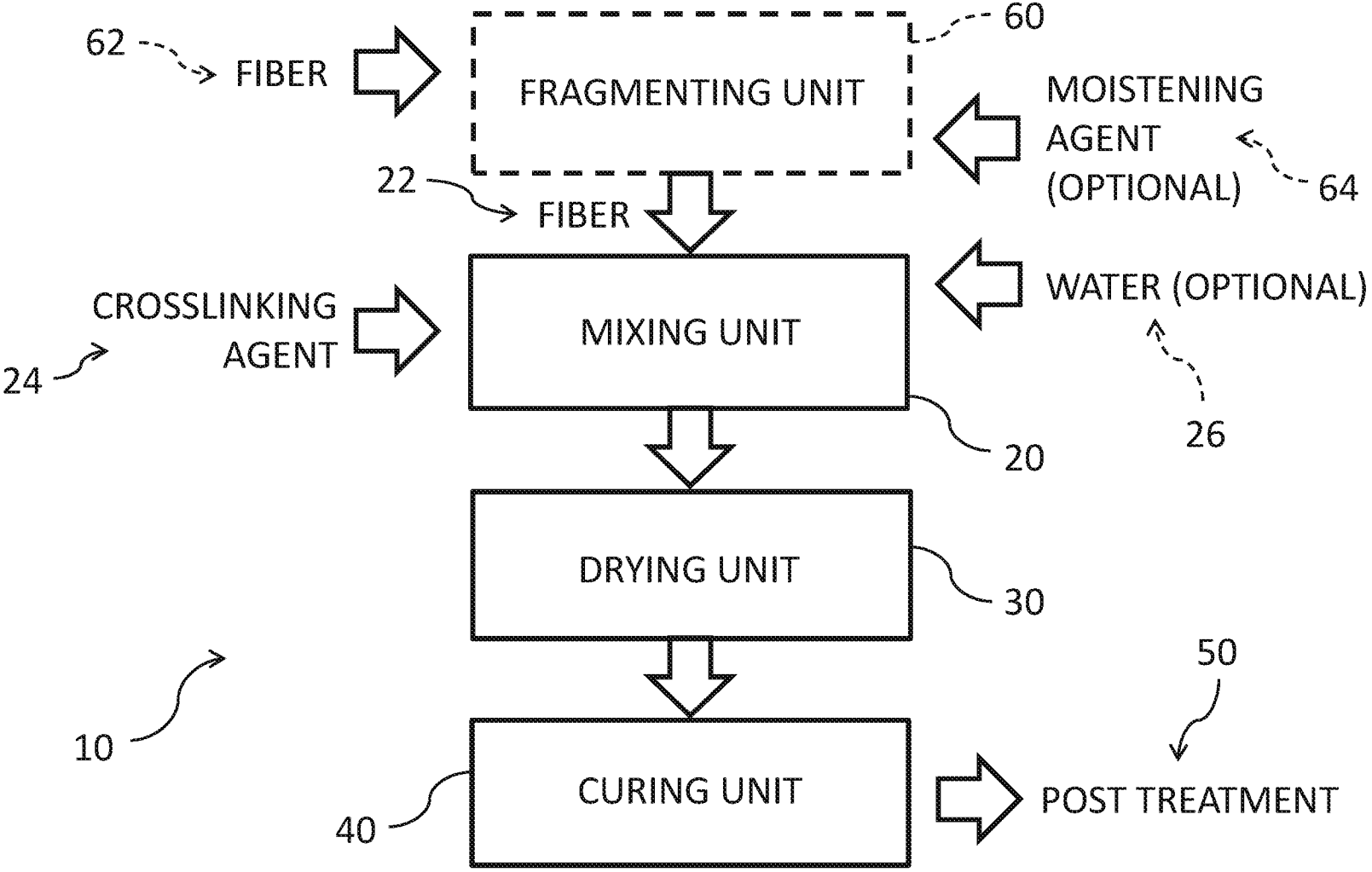
FIBER
62
FRAGMENTING UNIT
60
MOISTENING AGENT (OPTIONAL)
64
FIBER
22
CROSSLINKING AGENT
24
WATER (OPTIONAL)
26
MIXING UNIT
20
DRYING UNIT
30
CURING UNIT
40
POST TREATMENT
50
10

MODIFIED FIBER FROM SHREDDED PULP SHEETS, METHODS, AND SYSTEMS

CROSS-REFERENCE TO RELATED APPLICATION

This application is a division of U.S. application Ser. No. 14/983,402, filed on Dec. 29, 2015, now US Pat. No. 10,156,052, which application is expressly incorporated herein by reference in its entirety.

TECHNICAL FIELD

This disclosure relates to methods of and systems for forming modified fiber, in particular intrafiber crosslinked cellulose fibers, from pulp sheets and/or fragments of pulp sheets.

BACKGROUND

Traditionally, cellulose fibers from southern pine and other softwood species are used in absorbent products, in large part because the morphology of these fibers provides good absorbent performance. Compared to hardwood fibers, southern pine and other softwood fibers tend to be longer (e.g., having a length weighted fiber length of about 2.5 mm) and more coarse (e.g., having a coarseness greater than about 20 mg/100 m), and form low density pads with sufficient void volume to hold several times their weight in liquid. Hardwood fibers, on the other hand, are known for their performance in paper applications where shorter fiber length (e.g., about 1 mm) and lower coarseness (e.g., less than about 20 mg/100 m) provide a dense structure and smooth paper surface.

Crosslinked cellulose fibers are usually produced by applying a crosslinking agent to a dried sheet or roll of conventional softwood pulp fibers, generally at a dilute concentration to ensure chemical impregnation of the sheet, followed by wet fiberization in a hammermill to generate treated, individualized cellulose fibers. These fibers are then dried, such as in a flash drier, and cured, such as in an oven. The resulting fibers exhibit intrafiber crosslinking in which the cellulose molecules within a cellulose fiber are crosslinked. Intrafiber crosslinking generally imparts twist and curl to the cellulose fiber, and also imparts bulk to the fiber, properties that are advantageous in some absorbent products.

One drawback of this method is the high capital cost of the production process, as well as high energy costs due to drying the fiber prior to curing. Another drawback is that wet hammermilling can generate fiber and chemical buildup under usual mill conditions of heat and high airflow. Additionally, wet hammermilling produces undesirable features such as knots, which are unfiberized fiber clumps or pieces of the original pulp sheet. Generally, as production speeds increase, the level of knots also increases as the hammermilling efficiency is reduced.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

Various embodiments of methods of forming crosslinked cellulose products, as well as crosslinked cellulose products formed therefrom, are disclosed herein. The products may include, for example, individual crosslinked cellulose fibers, as well as mats, pads, sheets, webs, and the like generally made from individual crosslinked cellulose fibers.

In one aspect, the present disclosure provides methods of forming crosslinked cellulose products that include mixing a crosslinking agent with cellulose fiber mat fragments formed of hydrogen-bonded cellulose fibers having a high solids content—that is, a solids content of at least about 45% and up to about 95%. The crosslinking agent is added in an amount suitable to effect a desired level of crosslinking in the cellulose fibers based on the solids content of the mat fragments. In some methods, the mixing is sufficient to achieve individualizing (fluffing) the cellulose fibers while forming a substantially homogenous mixture of fibers and crosslinking agent. In some methods, the mixing is performed at ambient conditions. In some methods, the solids content of the mixture (of the crosslinking agent and the mat fragments) is set to be about 40-60%, such as by adding the crosslinking agent at a concentration that will achieve such a mixture solids content when mixed with the mat fragments. This may involve diluting or concentrating the crosslinking agent prior to mixing it with the mat fragments. The methods further include drying the resulting mixture (also referred to in terms of what it consists of—that is, chemically treated individual fibers) to 85-100% solids, then curing the dried chemically treated individual fibers to crosslink the fibers. Some methods further include, prior to mixing, preparing the mat fragments by fragmenting—that is, shredding, cutting, dicing, or otherwise breaking into pieces—a cellulose fiber mat or sheet, such as a pulp sheet. These mats or sheets may be provided in bale, wet lap, or roll form. In some cases, a mat or sheet may be moistened, such as to soften it, prior to or during fragmenting. Some examples of moistening agents include water, crosslinking agent, a catalyst solution, other liquid based additives, or various combinations thereof.

In one particular, non-limiting example of such a method, cellulose fiber mat fragments having a high solids content are formed by shredding, cutting or dicing a cellulose pulp sheet, followed by mixing a polyacrylic acid crosslinking agent with the mat fragments in an amount to achieve a chemical on pulp level of about 2-14%, wherein said crosslinking agent is mixed with the fiber fragments at ambient conditions. The target solids content of the mixture is about 50-60%, and is set by adding the crosslinking agent at a concentration suitable to achieve the target mixture solids content and the desired chemical dosage. During mixing, the mat fragments are individualized into discrete cellulose fibers in the mixer. The resulting chemically treated individual fibers are then dried and cured as above.

In another aspect, the present disclosure provides embodiments of a system for forming crosslinked cellulose products, which include a mixer configured to form, from cellulose fiber mat fragments formed of hydrogen-bonded cellulose fibers and having a high solids content of about 45-95% and a crosslinking agent, a substantially homogenous mixture of non-crosslinked, individualized cellulose fibers and crosslinking agent, at ambient conditions. This mixture is also referred to as chemically treated individual fibers. The system further includes, downstream of the mixer, a dryer configured to dry the substantially homogenous mixture to a consistency of 85-100% without curing the crosslinking agent; and a curing unit coupled to the dryer that is configured to cure the crosslinking agent, thereby forming dried and cured crosslinked cellulose fibers.

In yet another aspect, the crosslinking agent can be added to the pulp sheet prior to generating individual cellulose fibers by means described herein and other methods known in the art. More particularly, the crosslinking agent can be added to the pulp sheet or mat prior to the formation of the mat fragments, or after the formation of the mat fragments. Addition prior to fragmenting is possible by means such as coating, spraying, dipping, etc. Crosslinking agent can be added subsequent to fragmenting, for example, by spraying prior to mixing in the mixing unit. If wet lap is used as the starting cellulose mat, it is also possible to add the crosslinking agent during the wet lap process such that the crosslinking agent is present in the wet lap mat, for example in the targeted dosage.

In another aspect, the present disclosure provides intrafiber crosslinked cellulose pulp fibers having a chemical on pulp level of about 2-14% and an AFAQ capacity of at least 16.0 g/g. In some embodiments, the cellulose fibers are, or include, hardwood cellulose pulp fibers, such as eucalyptus cellulose pulp fibers or mixtures of fibers.

The concepts, features, methods, and component configurations briefly described above are clarified with reference to the accompanying drawing and detailed description below.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 1 is a schematic representation of an illustrative, non-limiting embodiment of a system suitable for producing crosslinked cellulose fibers in accordance with one aspect of the present disclosure.

DETAILED DESCRIPTION

According to one reference, U.S. Pat. No. 5,183,707 to Herron et al., there are three basic crosslinking processes. The first may be characterized as dry crosslinking, which is described, for example, in U.S. Pat. No. 3,224,926 to Bernardin. In a "dry crosslinking" process, individualized, crosslinked fibers are produced by crosslinking unswollen fibers in an aqueous solution with crosslinking agent, dewatering and defiberizing the fibers by mechanical action, and drying the fibers at elevated temperature to effect crosslinking while the fibers are in a substantially individual state. The fibers are inherently crosslinked in an unswollen, collapsed state as a result of being dehydrated prior to crosslinking. These processes produce what are referred to as "dry crosslinked" fibers. Dry crosslinked fibers are generally highly stiffened by crosslink bonds, and absorbent structures made therefrom exhibit relatively high wet and dry resilience. Dry crosslinked fibers are further characterized by low fluid retention values (FRV).

The second type, which is exemplified in U.S. Pat. No. 3,241,553 to Steiger, involves crosslinking the fibers in an aqueous solution that contains a crosslinking agent and a catalyst. Fibers produced in this manner are referred to as "aqueous solution crosslinked" fibers. Due to the swelling effect of water in cellulosic fibers, aqueous solution crosslinked fibers are crosslinked while in an uncollapsed, swollen state. Relative to dry crosslinked fibers, aqueous solution crosslinked fibers, for example as disclosed in the '553 patent, have greater flexibility and less stiffness, and are characterized by higher fluid retention value (FRV). Absorbent structures made from aqueous solution crosslinked fibers exhibit lower wet and dry resilience than structures made from dry crosslinked fibers.

In the third type, which is exemplified in U.S. Pat. No. 4,035,147 to Sangenis et al., individualized, crosslinked fibers are produced by contacting dehydrated, nonswollen fibers with crosslinking agent and catalyst in a substantially nonaqueous solution which contains an insufficient amount of water to cause the fibers to swell. Crosslinking occurs while the fibers are in this substantially nonaqueous solution. This process produces fibers referred to herein as "nonaqueous solution crosslinked" fibers. Such fibers do not swell even upon extended contact with solutions known to those skilled in the art as swelling reagents. Like dry crosslinked fibers, nonaqueous solution crosslinked fibers are highly stiffened by crosslink bonds, and absorbent structures made therefrom exhibit relatively high wet and dry resilience.

As explained in more detail herein, the present disclosure describes an additional, more viable and flexible approach, as compared to the three described by Herron.

In general, crosslinked cellulosic fibers can be prepared by applying a crosslinking agent(s) to cellulosic fibers in an amount sufficient to achieve intrafiber crosslinking under suitable conditions (e.g., temperature, pressure, etc.). Several examples of polyacrylic acid crosslinked cellulosic fibers and examples of methods for making polyacrylic acid crosslinked cellulosic fibers are described in U.S. Pat. Nos. 5,549,791, 5,998,511, and 6,306,251. A system and method that may be considered illustrative of the conventional approach to forming polyacrylic acid crosslinked cellulosic fibers is disclosed, for example, in U.S. Pat. Nos. 5,447,977 and 6,620,865. Accordingly, references to the "conventional approach" refer to the production of crosslinked cellulose fibers generally in accordance with that in the aforementioned patents, which follow the "dry crosslinking process" as described by Herron. Briefly, the system in these patents includes a conveying device for transporting a mat or web of cellulose fibers through a fiber treatment zone, an applicator for applying a crosslinking agent to the fibers at the fiber treatment zone, a fiberizer for separating the individual cellulose fibers that compose the mat, to form a fiber output consisting of substantially unbroken and essentially singulated (or individualized) cellulose fibers, a dryer coupled to the fiberizer for flash evaporating residual moisture, and a controlled temperature zone for additional heating of fibers and an oven for curing the crosslinking agent, to form dried and cured individualized crosslinked fibers.

Although current commercial processes for producing crosslinked cellulose fiber products may use different reagents, reagent quantities, reaction and other process conditions, and so forth, than those disclosed in the aforementioned '977 and '865 patents, for the purposes of the present disclosure, references herein to the current commercial process generally refer to the conventional approach outlined in these patents.

Various aspects of the conventional approach are described in more detail in the following paragraphs. The term "mat" refers to a nonwoven sheet structure formed from cellulose fibers or other fibers that are not covalently bound together, but are mechanically entangled and/or hydrogen-bonded. The fibers include fibers obtained from wood pulp or other sources including cotton rag, hemp, grasses, cane, cornstalks, cornhusks, or other suitable sources of cellulose fibers that may be laid into a sheet. The mat of cellulose fibers is generally in sheet form, and may be one of a number of baled sheets of discrete size or may be a continuous roll.

Each mat of cellulose fibers is transported by a conveying device, which carries the mat through the fiber treatment zone, where a crosslinking agent solution is applied to the mat. The crosslinking agent solution is applied to one or both surfaces of the mat using methods including spraying, rolling, dipping, etc. After the crosslinking agent solution has been applied, the solution may be uniformly distributed through the mat, for example, by passing the mat through a pair of press, compaction, or compression rollers or belts and the like.

The impregnated mat is then wet fiberized by feeding the mat through a hammermill. The hammermill disintegrates the mat into its component individual cellulose fibers, which are then air conveyed through a drying unit to remove the residual moisture.

The resulting treated pulp is then air conveyed through an additional heating zone (e.g. a dryer) to bring the temperature of the pulp to the cure temperature. In one variant, the dryer includes a first drying zone for receiving the fibers and removing residual moisture from the fibers via a flash-drying method, and a second heating zone for curing the crosslinking agent, to allow the chemical reaction (e.g., esterification, in some embodiments), to be completed. Alternatively, in another variant, the treated fibers are blown through a flash dryer to remove residual moisture, heated to a curing temperature, and then transferred to an oven where the treated fibers are subsequently cured. Overall, the treated fibers are dried and then cured for a sufficient time and at a sufficient temperature to achieve crosslinking.

As noted above, the conventional and historical approaches have some disadvantages. For example, in the conventional ("dry crosslinking") approach, the crosslinking solution is generally very dilute—and correspondingly very low viscosity, generally lower than 5 cP—in order to better assure complete impregnation of the chemical into the pulp sheet. As an additional measure to better assure complete impregnation, the conventional method also involves adding excess crosslinking chemical, which presents additional chemical handling concerns. In addition, wet fiberization, such as by a hammermill, leads to fiber and chemical buildup under usual mill conditions (sometimes referred to as contamination), which must be periodically removed, requiring production downtime. In addition, wet hammermilling tends to leave knots, with knot count generally increasing as production speeds increase, correspondingly decreasing hammermilling efficiency. Moreover, the conventional approach involves high energy costs due to wet hammermilling and water removal processes prior to curing the fiber. A downside to aqueous solution crosslinking is that a recycle/reclaim loop for excess water and chemical is needed and must be controlled and replenished.

Also, it has been found that the conventional approach is limited in terms of the types of cellulose fibers suitable for effective use with the dry crosslinking process, in which fiber mats are wetted with the aqueous crosslinking solution and then passed through rollers before being fed to a hammermill and fiberized. Accordingly, fibers that do not form mats of sufficient integrity to withstand mechanical manipulation when impregnated with a liquid tend to be much more difficult, if not impractical, to process efficiently on standard crosslinking equipment. For example, hardwood fibers are generally not used for absorbent products or in crosslinked cellulose fiber applications, because of their fiber morphology. In addition, some hardwood fibers, such as eucalyptus, form mats that fall apart easily when wet, and thus are not suitable fibers for use in the conventional approach.

The systems and methods disclosed in co-pending U.S. patent application Ser. No. 14/320,279, which involve mixing a crosslinking agent with unbonded cellulose fibers (that is, cellulose fibers that are not hydrogen or otherwise chemically bonded) that contain little to no excess water, may circumvent the aforementioned disadvantages, as well as provide an approach that can be used with a comparatively broader range of cellulose fibers. The systems and methods disclosed herein, which involve mixing a crosslinking agent with high-solids content cellulose fiber mat fragments, describe another alternative approach that has broader applicability while avoiding the aforementioned issues in the conventional crosslinking approach.

For example, mixing a crosslinking agent with cellulose fiber mat fragments—that is, fragments or pieces of a cellulose fiber mat formed from hydrogen-bonded cellulose fibers—at high solids content, can avoid the contamination and knot content issues associated with wet hammermilling. Such an approach may also eliminate the need for a chemical recycle loop. In addition, embodiments in which crosslinking agent is only added to the mixer may not require or otherwise involve mechanical manipulation of a chemically impregnated mat, and this aspect of the disclosed methods can reduce the contact of polymeric and potentially sticky crosslinking agents with process equipment, which in turn can reduce contamination and chemical buildup. The methods and systems disclosed herein also provide an option to crosslink high solids cellulose fiber mats and sheets that have low wet tensile strength or structural integrity, such as those from hardwood species such as eucalyptus, or cellulose fibers that are available in wet lap form. In addition, the methods of the present disclosure may be suitable for cellulose fibers from plant species other than hardwood or softwood trees, as well as cellulose that has been treated (such as mercerized fiber, and the like) or dissolved and regenerated (such as lyocell, and the like).

Cellulose fiber mat or sheet fragments at high solids suitable for use in the present disclosure may be produced by any suitable method, such as by shredding, cutting, or dicing a cellulose fiber mat or sheet. These and like processes are also referred to herein as "fragmenting." Fragmenting may be performed with no advance preparation of the mat or sheet, or may be accompanied by the application of moisture thereto, generally in the form of one or more moistening agents, such as to soften the mat to improve the ease of fragmenting and thereby reduce energy consumption. Moistening the mat may be done by standard methods such as spraying, curtain coating, immersion in a bath or vat, and so forth. Optionally, pulp in wet lap or other water-containing form (e.g., never-dried cellulose fibers) may be used.

The mat fragments, like the cellulose fiber sheet or mat from which they are formed, will be formed from, or composed of, hydrogen-bonded cellulose fibers. In other words, the mat fragments will in most cases consist essentially of hydrogen-bonded cellulose fibers, although in some embodiments the mat fragments may include some other types of fibers. The solids content of the mat fragments will generally be that of the cellulose fiber sheet or mat from which the mat fragments are formed, unless some moisture is removed, such as by drying, or applied, such as noted above. Conventional market pulp sheets generally have a solids content of around 90%, but this can vary somewhat depending on several factors including environmental conditions, wood type, pulping and/or drying method, and so forth. In some cases, the solids content may be as high as about 95%. On the other hand, pulp in water-containing form, such as wet lap, can have a solids content as low as about 45%.

In some embodiments, the mat fragments may have a solids content of about 60-80%. For example, some methods in accordance with the present disclosure may involve moistening a mat of cellulose fibers prior to or during fragmenting, such as to soften the mat to reduce strain on the equipment and/or energy cost. As noted above, market pulp sheets may have a solids content of about 90%, which may be decreased to about 80% by the addition of moisture for fragmenting. As another example, current mixing equipment—even that configured to accommodate high-solids mixtures—may be limited to effective processing of mixtures having a solids content of no more than 60%; accordingly, the mat fragments may be produced or processed to have such a solids content prior to being added to the mixer.

In methods in accordance with the present disclosure, the crosslinking agent is added to the high solids cellulose fiber mat fragments at a concentration suitable to achieve a desired solids content of the mixture. As such, although in the methods in accordance with the present disclosure, the desired mixture solids content is not limited to any particular range, practical considerations such as equipment capacity, chemical availability, and so forth, may effectively cap a range that can be achieved. For example, some currently available mixing devices suitable for use in the disclosed methods, such as a high-consistency mixer, may have difficulties effectively processing mixtures having too high of a solids content. As another example, some crosslinking agents are currently available only in aqueous solutions, even in concentrated form. Other factors, such as mixing time and other process considerations, may exist in a trade-off relationship and also may differ in effect on a suitable mixture solids content for different types of pulp fiber and/or crosslinking agent. In addition, not wishing to be bound by theory, less water present in the mixture may reduce the swelling of the fibers, and thus the ability of a crosslinking agent to fully penetrate the fiber cell wall. This in turn may increase fiber stiffness, a desired quality in crosslinked fibers, in that stiffer fibers are generally obtained when crosslinking is limited to the fiber surfaces. Accordingly there are various considerations that may direct a desired solids content of the mixture.

Methods according to the present disclosure may reduce some energy costs and other issues, such as risk of equipment contamination, associated with the "low solids" conventional crosslinking approach by reducing the amount of moisture present in the chemical components (up to current practical production and/or processing limits). In addition, crosslinked fiber produced according to the disclosed methods surprisingly provided better 5K density and AFAQ performance. Accordingly, although the inventors have found that a mixture solids content of about 40-50% with the combinations of equipment and materials used in the disclosed examples provides good results as compared to lower or higher mixture solids content ranges, the invention is not limited to this range. Indeed, mixtures having a solids content outside this range (e.g., of up to 60% solids) have also been found to have acceptable results. Given that the particular mixer used in the examples is recommended for mixtures having a solids content of up to 50%, the good results achieved with mixtures having up to 60% solids content were unexpected.

Thus, in some embodiments of the methods disclosed herein, the crosslinking agent is added to the high solids cellulose fiber mat fragments at a concentration suitable to provide a solids content of the mixture of about 50-60% and a desired chemical dosage (or COP). A typical concentration range for polymeric crosslinking chemicals is about 5-50% (prior to addition of any catalyst or water). Thus, in some cases, mixing may involve dilution of the crosslinking agent prior to or during its addition to the mat fragments, such as if the solids content of the mat fragments is higher than the desired mixture solids content. Optionally, moisture may be added to the mixture separately.

As used herein, the term "crosslinking agent" includes, but is not limited to, any one of a number of crosslinking agents and crosslinking catalysts. The following is a representative list of useful crosslinking agents and catalysts. Each of the patents noted below is expressly incorporated herein by reference in its entirety.

Suitable urea-based crosslinking agents include substituted ureas such as methylolated ureas, methylolated cyclic ureas, methylolated lower alkyl cyclic ureas, methylolated dihydroxy cyclic ureas, dihydroxy cyclic ureas, and lower alkyl substituted cyclic ureas. Specific urea-based crosslinking agents include dimethyldihydroxy urea (DMDHU, 1,3-dimethyl-4,5-dihydroxy-2-imidazolidinone), dimethyloldihydroxyethylene urea (DMDHEU, 1,3-dihydroxymethyl-4,5-dihydroxy-2-imidazolidinone), dimethylol urea (DMU, bis[N-hydroxymethyl]urea), dihydroxyethylene urea (DHEU, 4,5-dihydroxy-2-imidazolidinone), dimethylolethylene urea (DMEU, 1,3-dihydroxymethyl-2-imidazolidinone), and dimethyldihydroxyethylene urea (DDI, 4,5-dihydroxy-1,3-dimethyl-2-imidazolidinone).

Suitable crosslinking agents include dialdehydes such as C2-C8 dialdehydes (e.g., glyoxal), C2-C8 dialdehyde acid analogs having at least one aldehyde group, and oligomers of these aldehyde and dialdehyde acid analogs, as described in U.S. Pat. Nos. 4,822,453, 4,888,093, 4,889,595, 4,889,596, 4,889,597, and 4,898,642. Other suitable dialdehyde crosslinking agents include those described in U.S. Pat. Nos. 4,853,086, 4,900,324, and 5,843,061.

Other suitable crosslinking agents include aldehyde and urea-based formaldehyde addition products. See, for example, U.S. Pat. Nos. 3,224,926, 3,241,533, 3,932,209, 4,035,147, 3,756,913, 4,689,118, 4,822,453, 3,440,135, 4,935,022, 3,819,470, and 3,658,613.

Suitable crosslinking agents include glyoxal adducts of ureas, for example, U.S. Pat. No. 4,968,774, and glyoxal/cyclic urea adducts as described in U.S. Pat. Nos. 4,285,690, 4,332,586, 4,396,391, 4,455,416, and 4,505,712.

Other suitable crosslinking agents include carboxylic acid crosslinking agents such as polycarboxylic acids. Polycarboxylic acid crosslinking agents (e.g., citric acid, propane tricarboxylic acid, and butane tetracarboxylic acid) and catalysts are described in U.S. Pat. Nos. 3,526,048, 4,820,307, 4,936,865, 4,975,209, and 5,221,285. The use of C2-C9 polycarboxylic acids that contain at least three carboxyl groups (e.g., citric acid and oxydisuccinic acid) as crosslinking agents is described in U.S. Pat. Nos. 5,137,537, 5,183,707, 5,190,563, 5,562,740, and 5,873,979.

Polymeric polycarboxylic acids are also suitable crosslinking agents. Suitable polymeric polycarboxylic acid crosslinking agents are described in U.S. Pat. Nos. 4,391,878, 4,420,368, 4,431,481, 5,049,235, 5,160,789, 5,442,899, 5,698,074, 5,496,476, 5,496,477, 5,728,771, 5,705,475, and 5,981,739. Polyacrylic acid and related copolymers as crosslinking agents are described in U.S. Pat. Nos. 5,447,977, 5,549,791, 5,998,511, and 6,306,251. Polymaleic acid crosslinking agents are also described in U.S. Pat. No. 5,998,511.

Specific suitable polycarboxylic acid crosslinking agents include citric acid, tartaric acid, malic acid, succinic acid, glutaric acid, citraconic acid, itaconic acid, tartrate monosuccinic acid, maleic acid, polyacrylic acid, polymethacrylic acid, polymaleic acid, polymethylvinylether-co-maleate copolymer, polymethylvinylether-co-itaconate copolymer, copolymers of acrylic acid, and copolymers of maleic acid.

Other suitable crosslinking agents are described in U.S. Pat. Nos. 5,225,047, 5,366,591, 5,556,976, 5,536,369, 6,300,259, and 6,436,231.

Suitable catalysts can include acidic salts, such as ammonium chloride, ammonium sulfate, aluminum chloride, magnesium chloride, magnesium nitrate, and alkali metal salts of phosphorous-containing acids. In one embodiment, the crosslinking catalyst is sodium hypophosphite. Mixtures or blends of crosslinking agents and catalysts can also be used.

The crosslinking agent is added in an amount suitable to effect a desired level of crosslinking of the individual, high solids cellulose fibers based on the solids content. Herein, "desired level of crosslinking" may be characterized as the level of chemical on pulp (or "COP"), which is typically expressed as a mass percent. However, it may also refer to physical or chemical properties that have come to be associated with crosslinked cellulose fibers, such as absorbent capacity (or "AFAQ capacity"), 5K density, both described below, as well as others.

The determination of a desired level of crosslinking is often based on several considerations, such as a trade-off between increased fiber stiffness due to crosslinking and diminished capillary pressure, as well as material and energy costs, handling concerns, production rates, and so forth. As noted above, the amount of crosslinking agent may be characterized as COP, expressed as a mass percent. Some methods in accordance with this disclosure include adding the crosslinking agent at a COP of about 2-14%, a range that has been found, in the field of crosslinking cellulose fibers, to provide a favorable cost-to-performance tradeoff, although other COP levels and/or ranges are within the scope of this disclosure. In accordance with principles of process efficiency, in some methods, the amount of crosslinking agent is no more than is required to achieve the desired level of crosslinking.

The concentration of the crosslinking agent is generally selected such that the addition of the agent to the high solids cellulose fibers does not increase the water content of the resulting mixture beyond the desired range. On the other hand, a premature decrease in the water content (that is, prior to drying) of the resulting mixture below the desired range may also have undesirable effects. With some crosslinking agents, water removal may result in the mixture becoming sticky and/or otherwise difficult to handle, resulting in slower processing. One example of this may be seen with polymeric crosslinking agents, in which a lack of water causes the solids content of the mixture to increase and the polymer to become sticky. Accordingly, in methods in accordance with the present disclosure, the crosslinking agent is added to the aqueous mixture at ambient conditions, defined herein as a set of conditions (e.g., temperature, pressure, air flow, time, etc.) under which water loss from the solution is minimized.

The crosslinking agent may be mixed with the high solids cellulose fibers in any suitable manner, such as in a high consistency mixer, an extruder (or a region or segment of an extruder), a refiner, and so forth. One advantage to the use of a high consistency mixer, in some embodiments, is that a high consistency mixer not only allows direct injection of the crosslinking chemistry into the mixture at solids contents of up to about 50%, but the mixer also individualizes (or "fluffs") the fiber to prepare it for drying. Once mixed, the methods of the present disclosure include drying the mixture to about 85-100% solids, such as with standard drying apparatus (e.g., flash dryers, jet dryers, ring dryers, and so forth, or combinations thereof).

As noted above, practical limitations of currently available equipment and/or chemicals may effectively limit the solids content of the mixture to a range generally up to about 60%, and thus the term "drying" means reducing the moisture content, such as to the aforementioned range of 85-100% solids. However, the invention is not so limited, and contemplates higher solids content mixtures. Thus, in embodiments in which the solids content of the mixture is even higher, and in particular within the range of 85-100%, it should be understood that the term "drying" may indicate reducing the moisture level or instead may indicate maintaining the moisture level in the range of 85-100%.

Curing refers to the initiation and ensuing chemical reaction that creates chemical bonds between the crosslinking agent and the cellulose. Crosslinking occurs by different chemical reactions, depending on the crosslinking agent. For example, polyacrylic and polycarboxylic acid crosslinking agents typically establish chemical crosslinks by means of an esterification reaction. The present disclosure encompasses methods that proceed not only by esterification crosslinking reactions, but also other by other crosslinking reactions, such as etherification and so forth, as well as the reaction conditions suitable for such reactions. Methods in accordance with the present disclosure proceed by curing the dried mixture under conditions effective to crosslink the individual, chemically treated cellulose fiber derived from high solids cellulose mat or sheet fragments. Curing may be accomplished by any suitable manner, such as those used in the conventional approach, etc.

With the illustrative methods discussed above in mind, including the various steps, concepts, and variants therein, FIG. 1 can be seen to be a schematic representation of an illustrative, non-limiting embodiment of a system, generally indicated at 10, that is suitable for producing crosslinked cellulosic compositions in accordance with aspects of the present disclosure.

System 10 is shown in FIG. 1 to include a series of boxes connected by arrows. As will be described, the boxes represent different functional regions, or units, of system 10. The boxes, as well as the term "unit," are used for convenience, as each functional unit may be a single component (such as a machine, piece of equipment, apparatus, and so forth), or part of a larger component that also incorporates one or more other functional units, or may represent multiple components that cooperate to perform the function(s) of the unit, and so forth. Various functional units and components of system 10 may be co-located, such as within a single facility (such as a mill), or located remotely from each other. The system 10 may be any suitable scale, from lab scale to industrial/commercial. The arrows generally represent the direction of the material or product produced or processed by the various functional units, and, accordingly, may also represent any suitable means of conveying the material from one unit to another (such as conduits, conveyors, etc.), and/or other pieces of processing or handling equipment.

In FIG. 1, system 10 is shown to include, generally, a mixing unit 20 configured to mix fiber 22, in the form of high solids mat fragments, with crosslinking agent 24, to form a substantially homogenous mixture of non-crosslinked cellulose fibers and crosslinking agent; a drying unit 30 configured to dry the mixture to 85-100% solids; and a curing unit 40 configured to cure the crosslinking agent, thereby forming dried and crosslinked cellulose fibers. FIG. 1 also depicts some optional components of system 10, such as one or more post treatment processes, generally indicated at 50, as well as a fragmenting unit 60 upstream of the mixing unit 20 and configured to produce high solids mat fragments, for use in the mixing unit, such as from a cellulose pulp sheet. The various units and components are discussed in further detail below.

As noted above, mixing unit 20 is configured to form, from fiber 22 in the form of cellulose fiber mat fragments comprising hydrogen-bonded cellulose fibers and having a high solids content having a solids content of about 45-95% and crosslinking agent 24, a substantially homogenous mixture of non-crosslinked cellulose fibers and crosslinking agent, at ambient conditions. The mixing unit 20 may thus include, for example, a high consistency mixer, deflaker, or refiner to which the aforementioned mat fragments and crosslinking agent are added. Suitable examples of such equipment include high consistency mixers such as those manufactured by Andritz AG (Graz, Austria), Metso (Helsinki, Finland), and others; extruders (or portions thereof, such as a mixing/fluffing region of an extruder barrel downstream of a dewatering section, in some embodiments) such as those manufactured by Coperion (Ramsay, N.J.), Davis-Standard (Pawcatuck, Conn.), Milacron (Cincinnati, Ohio), and others; refiners such as those manufactured by Andritz Sprout Bauer, GL&V Pulp and Paper Group (Nashua, N.H.), and others; and so forth. The form and configuration of the equipment used for the mixing unit may be determined, to some extent, by the desired application. For example, an advantage to the use of a high consistency mixer, in some embodiments, is that such a mixer may allow direct injection of the crosslinking chemistry into the mixture at solids contents of up to about 50%, and also be configured to fluff the fiber to prepare it for drying. The mixing unit may optionally include any necessary metering and/or delivery equipment for the mixture components. Water 26 is also indicated as an optional feed to the mixer, schematically indicating that water may be added as a separate stream in addition to that provided with the mat fragments and/or the crosslinking agent.

Optionally, in some embodiments, the mixing unit 20 may be configured to process the fiber 22 and/or the crosslinking agent 24 prior to or during the mixing of the materials, such as to further break up the mat fragments, to pre-mix and/or meter the components, and so forth. In some of such embodiments, the mixing unit may be characterized as including separate zones (not separately shown) configured to perform various functions and form the substantially homogenous mixture. As an example of such an embodiment, the separate zones may be subsequent regions of an extruder. In some embodiments, for example those in which one or more materials, or the mixture, are dewatered to a desired solids content, the mixing unit 20 may include a water recycle/reclaim loop (not shown).

The mixing unit 20 is configured to mix the high solids mat fragments with the crosslinking agent, which as noted above may include one or more crosslinking chemicals and/or catalysts, as desired, under ambient conditions, that is, process conditions such as temperature, pressure, air flow, time, etc., under which water loss from the solution is minimized. The term "substantially homogenous," when used to describe the mixture including cellulose fibers, water, and crosslinking agent, indicates that the crosslinking agent is sufficiently well distributed among the individualized fiber so as to form consistent and uniform crosslinks throughout each fiber when dried and cured. As noted above, the mixing unit, such as in embodiments in which the mixing unit includes a high consistency mixer, may also fluff the fiber (that is, impart an increase in bulk density) in the mixture. Optionally, the mixing unit may include other equipment to fluff the mixture prior to drying.

Downstream of mixing unit 20 is a drying unit 30 configured to receive the mixture—that is, the chemically treated individual fibers—from the mixing unit and dry the mixture to 85-100% solids. Accordingly, drying unit 30 may include one or more drying devices, such as one or more ovens, float dryers, drum dryers, flash dryers, jet dryers, and so forth. In some embodiments, the drying unit 30 may also bring the fibers up to or near to curing temperature.

Finally, the dried fibers are received by a curing unit 40 configured to cure the crosslinking agent, thereby forming dried and crosslinked cellulose fibers. The curing unit thus may incorporate additional drying devices, ovens, and so forth. In some embodiments, the drying unit and/or curing unit may incorporate a holding area, such as to allow the fibers to equilibrate at a set temperature and/or time, or such equilibration may occur as the fibers are conveyed from one functional unit to the next. Some embodiments may include a recycle/reclaim loop for air/heat from curing equipment to drying equipment.

Once formed, the crosslinked fibers exit the curing unit 40 and may be subjected to various post treatment processes, indicated generally at 50, such as to prepare the fibers for shipment or storage, for example by being baled according to standard methods, which may include remoisturizing or other chemical post treatment followed by baling, and so forth.

As noted above, system 10 may optionally include a fragmenting unit 60 upstream of mixing unit 20 that is configured to produce mat fragments (that is, fiber 22) used in the mixing unit, for example from a cellulose mat or sheet, such as a cellulose pulp sheet. The fiber in this "un-fragmented" form is indicated generally at 62. Fragmenting unit 60, and fiber 62 in "un-fragmented" form used with it, are shown with dashed lines to indicate that these components need not be present in all embodiments of system 10. For example, some embodiments of system 10 may be configured to accept fiber 22 in the form of pre-made mat fragments. However, in embodiments of system 10 that include a fragmenting unit 60, the component may include one or more pieces of fragmenting and/or other processing or handling equipment, such as hoppers, conveyors, vats or baths, shredders, crushers, dicers, metering equipment, and so forth. The configuration of this equipment may depend on the form of the fiber 62, e.g., a cellulose sheet in bale or roll form, as well as its moisture content in such form, the desired form and/or moisture content of the resultant mat fragments, and so forth. For example, in some applications, it may be desired to provide mat fragments in a meterable form to mixing unit 20, in which case a dicer such as a Henion Dicer available from Henion Dicing Products, may be used to produce diced cellulose particles of substantially uniform mass or size. Other examples of suitable equipment include a Flow-Smasher™ Crusher available from Atlantic Coast Crushers and a Taskmaster® Paper and Pulp Shredder available from Franklin-Miller.

Optionally, a moistening agent 64 may be used in connection with fragmenting unit 60, such as to soften, moisten, or otherwise prepare fiber 62 for fragmenting. Some examples of moistening agents include water, a crosslinking agent, a catalyst solution, other liquid based additives, or various combinations thereof. The use of a moistening agent in the form of water sprayed onto one or both surfaces of a cellulose pulp sheet prior to fragmenting may reduce the energy required for the fragmenting process.

Fragmenting unit 60 may be configured to produce mat fragments of hydrogen-bonded cellulose fibers—that is, fiber 22—having the solids content desired for use in the mixing unit 20. Optionally, as noted above, the mixing unit 20 may incorporate some of the equipment and/or the functions of fragmenting unit 60. In one example embodiment, the mixing unit may be configured to accept fiber 22 in the form of mat fragments in any solids content and add sufficient water (either with crosslinking agent 24 or as a separate water stream 26) to achieve a desired mixture solids content.

The aforementioned descriptions are illustrative of any number of suitable application methods and systems, as well as combinations thereof, all of which are understood to be encompassed by the present disclosure.

A variety of properties of crosslinked cellulosic fibers can be measured by various tests, such as to determine absorbent and other properties of the material, such as to ascertain its suitability in various applications.

For example, absorbent properties of crosslinked cellulosic compositions (such as wet bulk, wick time, wick rate, absorbent capacity, and so forth), may be determined using the Automatic Fiber Absorption Quality (AFAQ) Analyzer (Weyerhaeuser Co., Federal Way, Wash.). A standard testing procedure is described in the following paragraphs.

A 4-gram sample (conditioned at 50% RH and 73° F. (23° C.) for at least 4 hours) of the pulp composition is placed through a pinmill to open the pulp, and then airlaid into a tube. The tube is placed in the AFAQ Analyzer. A plunger then descends on the airlaid fluff pad at a pressure of 0.6 kPa. The pad height is measured, and the pad bulk (or volume occupied by the sample) is determined from the pad height. The weight is increased to achieve a pressure of 2.5 kPa and the bulk recalculated. The result is two bulk measurements on the dry fluff pulp at two different pressures.

While under the plunger at the higher pressure, water is introduced into the bottom of the tube (to the bottom of the pad), and the time required for water to wick upward through the pad to reach the plunger is measured. From this, wick time and wick rate may be determined. The bulk of the wet pad at 2.5 kPa may also be calculated. The plunger is then withdrawn from the tube, and the wet pad is allowed to expand for 60 seconds. In general, the more resilient the sample, the more it will expand to reach its wet rest state. Once expanded, this resiliency is measured by reapplying the plunger to the wet pad at 0.6 kPa and determining the bulk. The final bulk of the wet pad at 0.6 kPa is considered to be the "wet bulk at 0.6 kPa" (in $cm^3/g$, indicating volume occupied by the wet pad, per weight of the wet pad, under the 0.6 kPa plunger load) of the pulp composition. Absorbent capacity (or "AFAQ capacity") may be calculated by weighing the wet pad after water is drained from the equipment, and is reported as grams water per gram dry pulp.

As another example, the 5K density test measures fiber stiffness and dry resiliency of a structure made from the fibers (i.e. its ability to expand upon release of compressional force applied while the fibers are in substantially dry condition). The 5K density test is disclosed in, for example, U.S. Pat. No. 5,873,979, and may be carried out according to the following procedure.

A 4×4 inch square (10.16×10.16 cm) air laid pad having a mass of about 7.5 g is prepared from the fibers for which dry resiliency is being determined, and compressed, in a dry state, by a hydraulic press to a pressure of 5000 psi. The pressure is then quickly released. The pad is rotated to ensure an even load and the compression and quick release are repeated. The thickness of the pad is then measured with an Ames Caliper Gauge applying a total load of 90 gf (0.88 N) including the 2 $in^2$ (12.8 $cm^2$) circular foot. This equates to a pressure of 0.1 psi (0.69 kPa). Five thickness readings are taken, one in the center and one from each of the four corners and the five values are averaged. After pressing, the pad slightly expands. The pad is trimmed to 4×4 in (10.16 cm×10.16 cm) and is weighed. Density after pressing is calculated as mass/(area×thickness). This density is denoted as the "5K density," so-called after the amount of pressure applied by the hydraulic press. Lower 5K density values correspond to greater fiber stiffness and greater dry resiliency.

The following examples summarize representative, non-limiting embodiments and methods of forming crosslinked cellulose products in accordance with the methods and concepts discussed above, and are illustrative in nature. The reagent amounts, times, conditions, and other process conditions may be varied from those disclosed in the specific representative procedures disclosed in the following examples without departing from the scope of the present disclosure.

EXAMPLE 1

Pulp sheets of southern pine fiber (CF416, Weyerhaeuser NR Company) were cut into 4 in×30 in (10.16 cm×76.2 cm) strips. When conditioned at 50% relative humidity and 73° F. (23° C.), cellulose fiber in this form has a moisture content of about 6.5%, corresponding to a solids content of about 93.5%. Based on this, the amount of water needed to increase the moisture content to 35% (corresponding to 65% solids) was calculated. Nine pulp strips were treated with additional water via syringe and placed in plastic bags overnight to equilibrate, thus generating nine pulp sheets with 65% solids content. These strips were then shredded by hand into approximately 1 in×1.5 in (2.54 cm×3.80 cm) rectangles. The desired amount of fiber for the test was fed via conveyor into a hopper. A screw at the bottom of the hopper fed the fiber into a laboratory Sprout refiner fitted with refiner plates (C2976) in a vertical configuration, with the gap set to minimize any fiber cutting (generally 0.050 in-0.300 in). Fiber was delivered at a fixed rate of 1168 OD g/min. Crosslinking agent (polyacrylic acid ("PAA") polymer and sodium hypophosphite ("SHP"), a catalyst) at 11.6% solids content was applied via a chemical port located at the end of the screw immediately before the fiber enters the refiner, with the chemical pump speed set to achieve a test COP level within the 2-14% range and a total solids content of the mixture in the refiner of 50-60% (the limit of the refiner). The treated fiber exited the refiner into a plastic bucket having measured solids content of 52%. At this final solids content, the COP level was calculated to be 6.5% based on the mass of fiber. The fiber was dried in a Fluid Energy 4-in ThermaJet™ jet dryer with a target inlet temperature of 356° F. (180° C.). Outlet temperature was measured to be about 120° C. at the conclusion of drying each sample. Dried fiber was equilibrated at room temperature before curing at 370° F. (187.8° C.) for 5 minutes in a forced air oven.

As a control using unbonded fibers, southern pine fiber (CF416, Weyerhaeuser NR Company) was slushed in a laboratory pulper in 1000 g (OD) batches at low solids (<10%) and then dewatered in a laboratory centrifuge. The dewatered fiber was broken down into smaller fiber bundles using a laboratory pin mill. The solids content of the fiber was measured to be 46.4%, and then the desired amount of fiber for the test was fed via conveyor into a hopper. A screw at the bottom of the hopper fed the fiber into a laboratory Sprout refiner fitted with refiner plates (C2976) in a vertical configuration, with the gap set to minimize any fiber cutting (generally 0.050 in-0.300 in). Crosslinking agent (PAA polymer together with SHP) at 20% solids content was applied via a chemical port located at the end of the screw immediately before the fiber enters the refiner. Fiber was delivered at a fixed rate of 1168 OD g/min. The chemical pump speed was set to achieve the aforementioned calculated COP level as well as a total solids content of the mixture in the refiner of 50-60%. The treated fiber exited the refiner into a plastic bucket at a measured solids content of about 43%. The fiber was dried in a Fluid Energy 4-in ThermaJet™ jet dryer with a target inlet temperature of 356° F. (180° C.). Outlet temperature was measured to be about 120° C. at the conclusion of drying each sample. Dried fiber was equilibrated at room temperature before curing at 370° F. (187.8° C.) for 5 minutes.

EXAMPLE 2

As in Example 1, pulp sheets of CF416 southern pine fiber were obtained from Weyerhaeuser and cut to 4 in×30 in (10.16 cm×76.2 cm) strips. The amount of water needed to increase the moisture content to 15% (corresponding to 85% solids) was calculated per Example 1. Nine pulp strips were treated with additional water via syringe and placed in plastic bags overnight to equilibrate, thus generating nine pulp sheets with 85% solids content. These strips were then shredded by hand into approximately 1 in×1.5 in (2.54 cm×3.80 cm) rectangles. The desired amount of fiber for the test was fed via conveyor into a hopper, then to a laboratory Sprout refiner configured as described in Example 1. Crosslinking agent (PAA polymer together with SHP) at 7.3% solids content was applied as in Example 1, sufficient for the calculated Example 1 COP, and with the chemical and fiber delivered at a rate to achieve a total solids content of the mixture in the refiner of 50-60%. The treated fiber exited the refiner into a plastic bucket at a measured solids content of 58%. The fiber was dried in a Fluid Energy 4-in ThermaJet™ jet dryer and cured as in Example 1.

Samples were compared to a control prepared under similar chemical loading and curing conditions, but according to the conventional method. Representative samples and their corresponding AFAQ capacity results at the target COP are shown in Table 1 (Sample UC represents the unbonded fibers control described in Example 1, and Sample CC represents the conventionally-produced control using the same crosslinking agent formation as in Examples 1 and 2). Table 1 indicates not only that effective crosslinking was achieved at high solids, but also that the AFAQ capacity of samples prepared according to the high solids methods of the present disclosure is unexpectedly greater as compared to a sample prepared according to the conventional method, and a sample prepared from unbonded fiber.

TABLE 1

| Sample ID | COP (%) | Starting Fiber Solids Content (%) | Solids Content in Mixer (%) | AFAQ Capacity (g/g) | 5K Density (g/cm$^3$) |
|---|---|---|---|---|---|
| Sample CC | 6.5 | 6 | n/a | 16.5 | 0.138 |
| Sample UC | 6.8 | 46 | 43 | 17.5 | 0.145 |

TABLE 1-continued

| Sample ID | COP (%) | Starting Fiber Solids Content (%) | Solids Content in Mixer (%) | AFAQ Capacity (g/g) | 5K Density (g/cm$^3$) |
|---|---|---|---|---|---|
| Example 1 | 6.5 | 65 | 52 | 18.4 | 0.133 |
| Example 2 | 6.2 | 85 | 58 | 18.9 | 0.115 |

Although the present invention has been shown and described with reference to the foregoing operational principles and illustrated examples and embodiments, it will be apparent to those skilled in the art that various changes in form and detail may be made without departing from the spirit and scope of the invention. The present invention is intended to embrace all such alternatives, modifications and variances that fall within the scope of the appended claims.

While illustrative embodiments have been illustrated and described, it will be appreciated that various changes can be made therein without departing from the spirit and scope of the invention.

The embodiments of the invention in which an exclusive property or privilege is claimed are defined as follows:

1. A system, comprising:

a high consistency mixing unit being configured to form, from cellulose fiber mat fragments comprising hydrogen-bonded cellulose fibers and having a solids content of about 45-95% and a crosslinking agent, a substantially homogenous mixture of crosslinking agent and non-crosslinked cellulose fibers in individualized form, at ambient conditions and being configured to directly inject the crosslinker onto the cellulose fiber mat fragments;

a drying unit downstream of the high consistency mixing unit and configured to dry the substantially homogenous mixture to a consistency of 85-100% without curing the crosslinking agent; and a curing unit downstream of the drying unit and configured to cure the crosslinking agent, thereby forming dried and cured crosslinked cellulose fibers.

2. The system of claim 1, wherein the high consistency mixing unit includes apparatus selected from the group consisting of an extruder, a hydrapulper, a refiner, a deflaker, and a high-consistency mixer.

3. The system of claim 1, wherein the high consistency mixing unit includes a high-consistency mixer.

4. The system of claim 1, further including a fragmenting unit upstream of the high consistency mixing unit and configured to form the cellulose fiber mat fragments from a cellulose fiber mat, wherein the fragmenting unit includes one or more of a crusher, a dicer, and/or a shredder.

5. The system of claim 4, wherein the high consistency mixing unit is configured to form, from cellulose fiber mat fragments consisting essentially of hydrogen-bonded cellulose fibers and having a solids content of about 45-95% and a crosslinking agent, said substantially homogenous mixture of non-crosslinked, individualized cellulose fibers and crosslinking agent, at ambient conditions.

6. The system of claim 4, wherein the fragmenting unit is configured to fragment a cellulose fiber mat that is moistened.

7. The system of claim 6, wherein the fragmenting unit is configured to moisten the cellulose fiber mat.

8. The system of claim 4, wherein the fragmenting unit is configured to fragment a cellulose fiber mat that is a pulp sheet, paper, paperboard, nonwoven, wet lap sheet consisting of never dried or previously dried cellulose, or a combination thereof.

9. The system of claim 4, wherein the fragmenting unit is configured to fragment a cellulose fiber mat in bale or roll form.

10. The system of claim 1, wherein the hydrogen-bonded cellulose fibers comprise hardwood fibers.

11. The system of claim 1, wherein the hydrogen-bonded cellulose fibers comprise eucalyptus fibers.

12. A system, comprising:

a fragmenting unit configured to form, from a hydrogen-bonded mat of cellulose fibers, cellulose fiber mat fragments comprising hydrogen-bonded cellulose fibers and having a solids content of about 60-80%;

a high consistency mixing unit downstream of the fragmenting unit and configured to form, from the cellulose fiber mat fragments and a polyacrylic acid crosslinking agent present in an amount and concentration to achieve a chemical on pulp level of about 2-14%, a substantially homogenous mixture of crosslinking agent and non-crosslinked cellulose fibers in individualized form, at ambient conditions, with the solids content of the mixture being about 50-60% and configured to directly inject the polyacrylic acid crosslinking agent onto the cellulose fiber mat fragments;

a drying unit downstream of the high consistency mixing unit and configured to dry the substantially homogenous mixture to a consistency of 85-100% without curing the crosslinking agent; and a curing unit downstream of the drying unit and configured to cure the crosslinking agent, thereby forming dried and cured crosslinked cellulose fibers.

13. The system of claim 12, wherein the hydrogen-bonded cellulose fibers comprise hardwood fibers.

14. The system of claim 12, wherein the hydrogen-bonded cellulose fibers comprise eucalyptus fibers.

* * * * *